United States Patent [19]

Suda et al.

[11] Patent Number: 4,968,597

[45] Date of Patent: Nov. 6, 1990

[54] HEAT DEVELOPABLE COLOR LIGHT-SENSITIVE MATERIAL

[75] Inventors: Yoshihiko Suda; Hiroyuki Kaguchi; Tawara Komamura, all of Hino, Japan

[73] Assignee: Konica Corporation, Tokyo, Japan

[21] Appl. No.: 436,942

[22] Filed: Nov. 14, 1989

Related U.S. Application Data

[63] Continuation of Ser. No. 199,324, May 26, 1988, abandoned.

[30] Foreign Application Priority Data

May 30, 1987 [JP] Japan ..... 62-135964

[51] Int. Cl.[5] ..... G03C 1/08

[52] U.S. Cl. ..... 430/617; 430/203; 430/551; 430/611

[58] Field of Search ..... 430/203, 551, 611, 617

[56] References Cited

U.S. PATENT DOCUMENTS 4,656,124 4/1987 Komamura ..... 430/548
4,720,451 1/1988 Shuto et al. ..... 430/379
4,728,600 3/1988 Hara et al. ..... 430/559
4,729,936 3/1988 Kitaguchi et al. ..... 430/151

*Primary Examiner*—Paul R. Michl
*Assistant Examiner*—Janet C. Baxter
*Attorney, Agent, or Firm*—Jordan B. Bierman

[57] ABSTRACT

A heat developable color photographic material is disclosed, which has a high speed and lowered fog. The photographic material comprises a blue-sensitive silver halide, a reducing agent and a binder, and a layer containing blue-sensitive silver halide contains a compound represented by the following formula I:

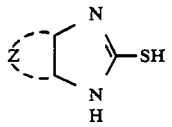

Formula I wherein Z represents a group of atoms necessary for completing an aromatic ring or a heterocyclic ring which may have a condensed ring.

8 Claims, No Drawings

HEAT DEVELOPABLE COLOR LIGHT-SENSITIVE MATERIAL

This application is a continuation, of application Ser. No. 199,324, filed May 26, 1988, now abandoned.

FIELD OF THE INVENTION

The present invention relates to a heat developable color light-sensitive material, which is a light-sensitive material which develops color images by heat treatment. In particular, this invention relates to a heat developable highly light-sensitive material with lowered fog.

BACKGROUND OF THE INVENTION

Light-sensitive material for facile and rapid obtaining of images with developing process of dry treatment by heat is conventionally known. Such heat developable light-sensitive material and its image forming method is described, for example, in Japanese Patent Examination Publicaiton patent Nos. 4421/1968 and 4927/1968, page 553-555 of "Fundamentals of photographic engineering" (published by Corona, 1879) and page 9–15 of "Research Disclosure", June, 1978 (RD-17029).

There are two kinds of heat developable light-sensitive materials: one for black and white images and the other for color images. In recent years, development of heat developable color light-sensitive material using a variety of coloring matter donors to obtain color image have been attempted.

Various heat developable color light-sensitive materials utilize a variety of methods. For example, a method to obtain color image by coloring matter transfer after releasing or forming a diffusible coloring matter by heat development (hereinafter called transfer method) needs an image receiver to receive transcribed image, but is superior at stability and clearness of images and facility and speediness of processing. The heat developable color light-sensitive material and image forming process of transfer method is described in specifications of Japanese Patent Publications Open Public Inspection (hereinafter referred to as Japanese Patent O.P.I. Publication) Nos. 12431/1984, 159159/1984, 181345/1984, 229556/1984, 2950/1985, 52643/1986, 61158/1986, 61157/1986, 180550/1984, 132952/1986, and 139842/1986, as well as U.S. Pat. No. 4,595,652, No. 4,590,154 and No. 4,585,267.

These heat developable light-sensitive materials contain light-sensitive silver halide, organic silver salt and binder, and additionally contain color providing material in case of color light sensitive material. It is well known in the art that the silver halide emulsion is made highly sensitive by chemical sensitization. Sulfur sensitization, reducing sensitization, selenium sensitization and sensitization by precious metal such as gold are used individually or in combination as chemical sensitization.

Further, addition of azaindenes during chemical ripening or before coating of the silver halide emulsion to obtain high sensitivity is described in British patent No. 1,315,755 and Japanese Patent O.P.I Publication No. 77223/1976 and No. 140335/1985.

It was difficult, however, to satisfy the demand of photography of high sensitivity and lower fog when conventional silver halide emulsion was used for heat developable light-sensitive material. Accordingly, a strong need exists for sensitivity improvement of heat developable light-sensitive material containing light-sensitive silver halide. In particular, it is desired to obtain a higher sensitivity for the layer containing blue light-sensitive silver halide than those for other color sensitive layers for example, green-sensitive layer and red-sensitive layer to avoid optical color mixing between blue-sensitive layer and other layers.

SUMMARY OF THE INVENTION

It is an object of the invention to provide a heat developable color light-sensitive material with high sensitivity and lowered fog. More sepcifically, it is an object of this invention to provide a heat developable light-sensitive material with a blue-photosensitive layer of high sensitivity, lowered fog and good developability.

The above objects of the present invention is achieved by a heat developable color light-sensitive material comprising a support having thereon, photographic component layers containing at least a blue-sensitive silver halide, a reducing agent and a binder, wherein a photographic component layer containing the blue-sensitive silver halide, contains a compound represented by the following formula I.

Formula I

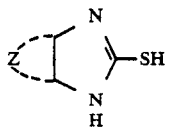

In this formula, Z represents a group of atoms necessary to form an aromatic ring or a heterocyclic ring. The aromatic ring or heterocyclic ring may include the one provided with substituent, or it may form a condensation ring.

The chemical compound represented by the above formula I relating to the present invention will be described later.

DETAILED DESCRIPTION OF THE INVENTION

In the heat developable light-sensitive material of the present invention, light-sensitive silver halide and reducing agent is not necessarily contained in the same layer. And it is needless to say that some color providing materials serving also as a reducing agnet can be used as the reducing agent of the present invention.

The heat developable light-sensitive material of the present invention can be embodied both as a monochromatic light-sensitive material and a polychromatic light-sensitive material.

Color providing material to be used the here can be freely selected. It is preferable to use, but not limited to, a diffusible color providing material.

Heat developable light-sensitive material may adopt the transfer method or other methods. For high image quality, transfer method is advantageous. On the other hand, methods other than transfer have the advantage of not needing a receiving member.

In the present invention, the compound represented by the formula I is contained in any layer of the photographic component layers.

Following is the detailed description of the compound represented by the formula I relating to this invention.

Formula I

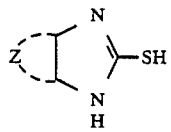

As mentioned above, Z in this formula represents a group of atoms necessary to form aromatic ring or a heterocyclic ring. The aromatic ring or heterocyclic ring may include the one provided with substituent, or it may form a condensation ring.

Among the compounds represented by the formula I, the compound represented by the formula II below is preferable.

Formula II

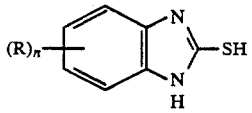

[In this formula, R represents a hydrogen atom, an alkyl group, an aryl group, a substituted aryl group, an alkoxy group, and an aryloxy group; and n represents 0, 1 or 2. R may form a ring condensed with the benzene ring.]

Compounds represented by the above formula I to be used in this invention include, but not limited to, the examples given below:

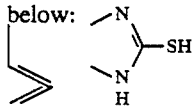

(1)

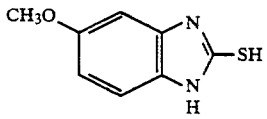

(2)

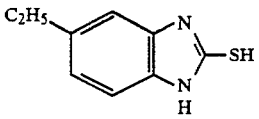

(3)

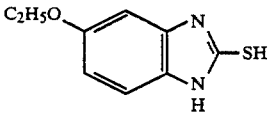

(4)

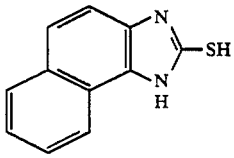

(5)

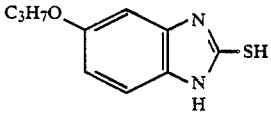

(6)

-continued

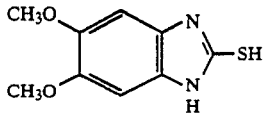

(7)

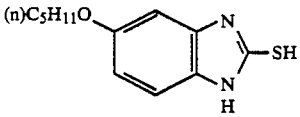

(8)

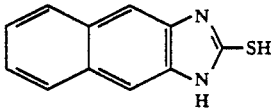

(9)

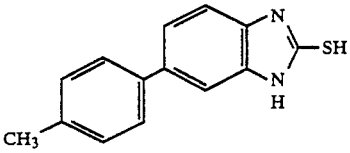

(10)

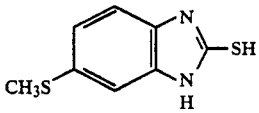

(11)

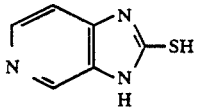

(12)

The compounds shown above can be easily synthesized through the reaction of corresponding diamine and carbon disulfide. A synthesis example of one of the compounds is given below.

(Synthesis example of illustrated compound (2))

20 g of 3, 4 diaminoanisole were heated and refluxed with 40 g of carbon disulfide in methanol. Three hours later, through filtering of the yellow crystal produced by the reaction and recrystallization in methanol, 15 g of needle crystal having a melting point of 260°–262° C. was obtained.

Normally, compounds represented by the formula I relating to the present invention is the compound to be contained in silver halide light-sensitive material to avoid fogg. Addition of $3.0\times10^{-3}$ mol or more per mol of silver halide is said to seriously lower the sensitivity. However, addition of the compound of this invention to the heat developable light-sensitive material, for example $3.0\times10^{-3}$ mol or more per mol of silver halide, can result in high sensitivity and images with lowered fog. This result is not expected from prior knowledge.

Applied amount of the compound represented by the formula I in the present invention is preferably $3.0\times10^{-3}$ to $2.0\times10^{1}$ mol, and more preferably, $5.0\times10^{-3}$ to $1.0\times10^{-1}$ mol The compound may be individually added, or two more kinds of the compounds may be added in combination. When two or more of the compounds are used in combination, it is preferable to keep the total amount in the above range.

Compounds of the present invention may be added either as dispersion in organic solvent such as methanol, ethanol, propanol, acetone, alcohol fluoride, dimethyl formamide, and methyl cellosolve or a form of dispersion dispersed in water/gelatin solution, or as solution prepared by dispersion with surface active agent.

Addition timing can be either during or before the silver halide emulsion manufacturing process, but it is preferable to be during the chemical ripening, when starting, when ended and before coating. Addition of the compound represented by the formula I before the coating results in producing preferable light-sensitive material of high sensitivity with lowered fog.

Following description is about color providing material which can be used in heat developable color light-sensitive material of the present invention.

As the color providing material, for example, the coupler forming non-diffusible dye described in Japanese O.P.I. Publication Patent Nos. 44737/1987, 129852/1987, 169158/1987, or leuco dye described in U.S. Pat. No. 475,441, or azo dye used in heat development dye bleaching method described in U.S. Pat. No. 4,235,957 etc. can be used, but it is preferable to use a diffusible color providing material substance which forms or releases diffusible dye, and in particular, a compound which forms diffusible dye with coupling reaction is further preferred.

Diffusible color providing material which can be used for the present invention are explained below. Any diffusive color providing material which participates in reducing reaction of light-sensitive silver halide and/or organic silver salt being used as desired, and forms or releases diffusible dye as a function of such reaction can be used. Such color providing material are, according to its reaction form, classified into the negative type color providing material which acts for positive function, i.e. negative dye images are formed for negative type silver halide, and the positive type color providing material which acts for negative function, i.e. positive dye images are formed for negative type silver halide.

As a negative type color providing material for example, a reducing dye releasing compound described in specifications of U.S. patent No. 4,463,079, No. 4,439,513, Japanese Patent O.P.I. Publication No. 60434/1984, No. 65839/1984, No. 71046/1984, No. 87450/1984, No. 88730/1984, No. 123837/1984, No. 124329/1984, No. 165054/1984, and No. 164055/1984 can be used.

Another negative color providing material is, for example, a coupling dye releasing compound described in specifications of U.S. Pat. No. 4,474,867, Japanese Patent O.P.I. Publication No. 12431/1984, No. 48765/1984, No. 174834/1984, No. 776642/1984, No. 159159/1984, and No. 231540/1984.

Another particularly preferable negative color providing material is a coupling dye forming type compound represented by the formula 1.

C p—J—B)

In the above formula, Cp represents an organic group which can form a diffusible dye upon coupling reaction with oxidized product of reducing agent. J is a divalent combination group whose combination with Cp will subject to cleavage through reaction with oxidation product of reducing agent. B represents a ballast group. Here, the ballast group refers to the group to substantially avoid diffusion of color providing material during the heat development process. It may be the group which has such action because of the molecule nature (sulfo group, for example) or the group with such nature because of the size (groups with a large number of carbon atoms). To improve diffusion of formed dye, the coupler residue has preferably 700 or less molecule weight or more preferably, 500 or less molecule weight.

It is preferable to have a ballast group having 8 or more, more preferably, 12 or more carbon atoms, or a sulfo group. A group containing both carbon molecules and sulfo group is preferable and a group forming a polymer chain is even more preferable.

As a coupling type dye forming compound with a polymer chain group, a compound with a polymer chain having repetitive units induced by the monomer represented by the formula 2 for this polymer chain group is preferable.

C p—J—Y Z'L)

In this formula, Cp and J represent the same thing as defined in 1; Y represents an alkylene group, an arylene group or an aralkylene group; l represents an integer of 0 or 1, Z' represents a divalent organic group; and L represents an ethylenic unsaturated group or a group containing an ethylenic unsaturated group.

Specific examples of the coupling type dye forming compound represented by the formula 1 and 2 are described in Japanese Patent O.P.I Publication No. 124339/1984, No. 181345/1984, No. 2950/1985, No. 57943/1986 and No. 59336/1986; as well as U.S. Pat. No. 4,631,251, No. 4,650,748 and No. 4,650,748. Particularly, it is preferable to use the polymer type color providing material described in U.S. Pat. No. 4,656,124, No. 4,631,251, and No. 4,650,748.

Positive type color providing material include, for example, dye developing agent compound described in Japanese Patent O.P.I. Publication No. 55430/1984 and 165054/1984 etc., compound which release diffusible dye by intramolecular nucleophilic reaction described in the same Publication No. 15445/1985, No. 766954/1984 etc., cobalt complex compound described in the same patent No. 116655/1984 etc. or for another example, compound which loses dye releasing ability after oxidation described in the same Publication No. 124327/1984, 152440/1984 etc.

In order to obtain a high diffusibility, group with 800 or less, or more preferably, 600 or less molecule weight is desired as the remaining group of diffusive dye in the color providing material used in this invention.

Examples of such remaining group are azo dye, azomethine cye, anthraquinone dye, naphthoquinone dye, styryl dye, nitro dye, quinoline dye, carbonyl dye, phthalocyanine dye etc. These dye residue can be temporarily in the short wave form absorbing light of short wave regiand, which can be returned to color during heat development or transfer. In a preferable embodiment, in order to improve light resistance of images, chelatable dye residue described in Japanese Patent O.P.I. Publication No. 48765/1984 and No. 124337/1984 is used.

These color providing material may be individually used or two or more doners may be used together. Amount of the donor is not limited and may be determined depending on the kinds of color providing material, whether single material is individually used or plurality of materials are used at the same time, and whether the photographic component layer of this invention is single-layered or multi-layered. Application amount is, for example, 0.005 g to 50 g, or more preferably, 0.1 g to 10 g.

Any method may be used to make photographic component layer of heat developable light-sensitive material contain the color providing material for this invention.

For example, supersonic wave dispersion after solving in low-boiling solvent such as methanol, ethanol, ethyl acetate etc. or high-boiling solvent such as dibutyl phthalate, dioctyl phthalate, tricresyl phosphate etc., or neutralization with acid, for example, citric acid or nitric acid etc. after solving i alkaline water solution 10% aqueous sodium hydroxide, for example, or diffusion in appropriate aquious polymer solution, for example, gelatin, polyvinyl butyral, polyvinyl pyrrolidone etc. with ball mill.

Light-sensitives silver halide used in this invention will be explained below. Silver halide which can be used in the invention includes silver chloride, silver bromide, silver iodide, silver chlorobromide, silver chloroiodide, silver iodobromide etc. Such light-sensitive silver halide can be prepared with any method such as single jet method generally used in the art of photographic material.

In a preferable embodiment of this invention, light-sensitive silver halide contained in heat developable light-sensitive material has the silver iodide content of 0 mol% to 40 mol%, or more preferably, 0.1 mol% to 4 mol%. Preferable silver halide for this case is silver iodobromide, or silver iodochlorobromide. Either acid process, neutral process or ammonia process may be used for preparation of preferable silver halide, but in particular, ammonia process is suitable. For reaction form between soluble silver salt and soluble halide salt, either separate single-jet mixing method, double-jet mixing method, or the combination of both may be used. Reverse mixing method in which silver halide particles are formed in the presence of excess silver ions may be also used. As one of the double-jet mixing methods, controlled double-jet method which freely controls pAg in the solution in the reaction container for silver halide production and controls addition rate of silver and halide solution may be used. With this method, "monodisperse" silver halide emulsion (to be explained later), in which individual crystal and particle of silver halide have nearly uniform size, can be obtained.

In the present invention, for light-sensitive silver halide contained in heat developable light-sensitive materials, core/shell structured halide may be used. In a preferable embodiment of this invention, core/shell type silver halide particles having different halide composition of the particles in multi-layer structure for the surface and for the inside are used. Here, silver halide particles with its halide composition changed to steps-form, or a silver halide emulsion with continuously changed particles can be used.

The shape may have either a clear crystal habit such as cube, globe, octahedron, dodecahedron, and tetradecimalhedron or no clear crystal habit. Silver halide of this kind includes the one described in Japanese Patent O.P.I. Publication No. 215948/1985.

More preferable core/shell type light-sensitive silver halide particles used in this invention is the core/shell type particles having the shells of surface latent image forming type.

Even more preferable core shell type light-sensitive silver halide particles emulsion used in this invention can be manufactured by covering the core of monodispersed light-sensitive silver halide particles with shell.

To have cores of the monodispersed silver halide particles, disired size of particles can be obtained with double-jet method with keeping constant pAg value. For silver halide emulsion containing highly monodispersed light-sensitive silver halide, methods described in Japanese Patent O.P.I. Publication No. 48521/1979 can be adopted. Among these methods, preferable embodiment is the preparation by addition of potassium iodide and bromide-gelatin aqueous solution and ammonical silver nitrate aqueous solution to the gelatin aqueous solution containing silver halide seed particles, with changing addition rate as function of time. By selecting time function of addition rate, pH, pAg, temperature etc,, silver halide emulsion containing silver halide particles for high monodispersed core can be obtained.

By gradually growing the shell according to the monodispersed emulsion preparing method using monodispersed core particles described above, monodispersed core/shell type light-sensitive silver halide emulsion to be preferably used in this invention can be obtained.

Even more preferable core/shell type light-sensitive silver halide for this invention has particles with cores covered with shells whose thickness is preferably 0.05% to 90%, or more preferably, 1% to 80% of the silver halide particle size. In the silver halide composition of the core, preferable the silver iodide content is 0.1 mol% to 20 mol%. More preferably, in the silver halide composition of the shell, silver iodide content of the core is 0 mol% to 6 mol%. Far more preferable example is a core/shell type silver halide with the silver iodide content in the core is 2 mol% or more larger than that in the shell. In a particularly preferable embodiment, silver iodide content of the core is 2 mol%, silver iodide content of the shell is 0% and the volume ratio between core and shell is 1:1, which means that the silver iodide content of the entire particle is 1 mol%.

Also usable for this invention is the silver halide emulsion containing tabular particles described in Japanese Patent O.P.I. Publicaton No. 111933/1983, No. 111934/1983, No. 108526/1983 and in Research Disclosure No. 22534. These particles have two parallel crystal surfaces and both of these surfaces have a larger area than that of other crystal surface of the particles, and the aspect ratio, or the ratio of diameter versus thichness is 5:1 or more.

Silver halide emulsion containing internal latent image type silver halide particles without surface fogging can be also used in this invention. Description of the internal latent image type silver halide particles without surface fogging is given in the specifications of U.S. Pat. No. 2,592,250, No. 3,206,313, No. 3,317,322, No. 3,511,622, No. 3,447,927, No. 3,761,266, No. 3,703,584, No. 3,736,140, etc. Internal latent image type silver halide particles without surface fogging are, as described in above specifications, with higher sensitivity in the particles than on the surface. Other examples include the silver halide emulsion which has silver halide particles containing polyvalent metal ions described in specifications of U.S. Pat. No. 3,271,157, No. 3,447,927 and No. 3,531,291, the silver halide emulsion with silver halide particles whose surface is lightly chemical sensitized and which contains doping agent described in the specification of the U.S. Pat. No. 3,761,276, the silver halide emulsion composed of particles having layered strucrture described in Japanese Patent O.P.I. Publication No. 8524/1975, 38525.1975 etc., and the silver halide emulsion described in Japanese Patent O.P.I. Publication No. 156614/1977 and No. 127549/1980.

Light-sensitive silver halide used in this invention may be chemically sensitized with any method in the field of photographic technology.

In a preferable embodiment of this invention, silver halide particles contained in heart developable light-sensitive material are gold sensitized. Other chemical sensitization may be used in combination here. Chemical sensitization by combined use of sulfur sensitization and gold sensitization is preferable.

Oxidation number of gold in gold sensitizer used for gold sensitization can be freely selected and the value of +1 or +3 can be used, which means that various gold compounds are acceptable. Typical examples of gold sensitizer include chloroauric acid and its salt, potassium chloroaurate, auric trichloride, potassium auric thiocyanate, potassium iodoaurate, tetracyanoauric acid, ammonium aurothiocyanate, and pyridyl trichloro gold.

Amount of added gold sensitizer depends on various conditions, but standard amount as a guidline is 0.1 to 10 mg, or more preferably, $1.5\times10^{-1}$ to $4.0\times10^{-1}$ mg per 1 mol of silver halide.

Any sulfur sensitizer is used for combined use with a gold sensitizer or for independent use.

Sulfur sensitizers include thiosulfate, allylthiocarbamidenthiourea, allylisothiocyanate, cistine, p-toluenethiosulfonate, and rhodanine. Sulfur sensitizers described in U.S. Pat. No. 1,574,944, No. 2,410,689, No. 2,278,947, No. 2,728,668, No. 3,501,313, No. 3,656,955, German patent No. 1,422,869, Japanese Patent O.P.I. Publication No. 24937/1981 and No. 45016/1980 can be also used. Adding amount of sulfur sensitizer is sufficient with the amount to effectively improve the emulsion sensitivity. The amount varies in a wide range depending on various conditions such as pH, temperature, and silver halide particle size, but the standard amount as a guidline is about 0.5 to 2.0 mg, or more preferably, 0.7 to 1.5 mg per 1 mol of silver halide.

When using gold sensitizer and sulfur sensitizer in combination, either sensitizer can be added first, or both can be added at the same time.

Chloroauric acid or its salt is preferable as the gold sensitizer, and as the sulfur sensitizer to be used in combination with gold sensitizer, thiosulfate is preferable.

Silver halide particles used in this invention can be either coarse particles or fine particles, but a preferable particle size is about 0.001 μm to 1.5 μm in diameter, or more preferably, about 0.01 μm to 0.5 μm.

In this invention, another preparation method of light-sensitive silver halide to be used is the technique to have coexistance of a light-sensitive silver salt forming component and an organic silver salt described later, in order to form the high-sensitive silver halide in a part of organic silver salt.

Such light-sensitive silver halide and light-sensitive silver salt forming component may be used in various condition of combination, and the amount to be used is preferably 0.001 g to 50 g, or more preferably, 0.1 g to 10 g per 1 $m^2$ of support in one layer.

Typical spectral sensitizing dye include, for example, cyanin, merocyanin, complex, i.e. having 3 or 4 nuclei, cyanin, phoropolar cyanin, styryl, hemicyanin, and oxonol.

Preferable adding amount of these sensitizing dye is $1\times10^{-4}$ to 1 mol, and more preferably, $1\times10^{-4}$ to $1\times10^{-1}$ mol per mol of light-sensitive silver halide or silver halide forming component.

In heat developable light-sensitive material in this invention, various organic silver salt can be used to improve sensitivity and developability.

Organic silver salts to be used for the heat developable light-sensitive material of this invention include the silver salt of long-chain aliphatic carboxilic acid or silver salt of carboxilic acid with helerocyclic ring such as silver lauric acid, silver myristic acid, silver palmitic acid, silver stearic acid, silver arachidic acid, silver behenic acid and silver alpha-(1-phenyltetrazolethio) acetate, or aromatic silver carboxilic acid such as silver benzoate and silver phtalic acid, or silver salt of imino group described in specifications of Japanese Patent Examined Publication Nos. 26582/1969, 12700/1970, 18416/1970, 22185/1970, 137321/1977, 118638/1983, 118639/1983 and U.S. Pat. No. 4,123,274.

In addition, silver complex compound with stability constant of 4.5 to 10.0 described in Japanese O.P.I. Publication No. 31728/1977 and silver salt of imidazolinethion described in specification of U.S. Pat. No. 4,168,980 can be used.

Among organic silver salt above, silver salt with imino group is preferable, and in particular, silver salt of benzotriazole derivatives, and more preferably, 5 - methylbenzotriazole and its derivatives, sulfobenzotriazole and its derivatives, N-alkylsulfamoyl benzotriazole and its derivatives may be used.

Organic silver salt used in this invention can be used individually or in combination with one or more kinds of silver salts. After silver salt preparation in an appropriate binder, it may be used either without isolation or after having been isolated and dispersed in a binder with appropriate means. Dispersion means include, but not limited to, ball mill, sand mill, colloid mill, and oscillating mill.

To prepare organic silver salt, in general, silver nitrate and raw organic compound is dissolved in water or organic solvent for mixing, but binder addition, or addition of alkali such as sodium hydroxide to improve organic compound solution, or use of ammonium silver nitrate solution is effective, if desired.

Usual amount of such organic silver salt is preferably 0.01 mol to 500 mol, or more preferably 0.1 to 100 mol per 1 mol of light-sensitive silver halide. Far more preferable amount is 0.3 to 30 mol.

For reducing agent (precursor shall be included in reducing agents in the present specification) used as heat developable light-sensitive materials of this invention, agents usually used in the field of heat-developable lightsensitive material can be utilized.

Reducing agents for this invention includes, for example, developing agents of p-phenylenediamine type and p-aminophenol, developing agents of phosphoroamid phenol type and sulfonamide aniline type, color developing agents of hydrazone type and their precursor, or phenol phenols, sulfonamide phenols, polyhydroxy benzenes, naphthols, hydroxybinaphthyls and methylene bisnaphthols, methylene bisphenols, ascorbic acid, 3-pyrazolidones, and pyrazolones, which are described in specifications of U.S. Pat. No. 3,531,286, No. 3,761,270, No. 3,764,328, and RD (Research Disclosure) No. 12146, No. 15108, No. 15127, and Japanese Patent O.P.I. Publication No. 27132/1981, specifications of U.S. Pat. No. 3,342,599, No. 3,719,492, Japanese Patent O.P.I. Publication No. 135628/1978 and No. 79035/1982.

Particularly preferable reducing agent is N-(p-N, N-dialkyl) phenylsulfamic acid salt, described in Japanese Patent O.P.I. Publication No. 146133/1981, No. 227141/1987.

Two or more of the above reducing agents can be used at the same time. Amount of the reducing agents to be used for heat developable light-sensitive material is not constant and depends on conditions such as type of utilized light-sensitive silver halide, type of organic acid silver salt and type of other additives, but the preferable amount is usually falls in the range from 0.01 to 1500 mol, or more preferably, 0.1 to 200 mol per mol of light-sensitive silver halide.

Binders which can be used for heat developable light-sensitive material are synthetic and natural high molecular substance including polyvinyl butyral, polyvinlyl acetate, ethyl cellulose, polymethyl methacrylate, cellulose acetate butyrate, polyvinyl alcohol, polyvinyl pyrrolidone, gelatin derivatives such as phthalated gelatin, cellulose derivatives, protein, starch, and gum arabic. Either one individual binder or two or more binders in combination can be used. Preferable practice is to use gelatin or its derivative and hydrophilic polymer such as polyvinyl pyrrolidone and polyvinyl alcohol in combination, or more preferably, to use a mixed binder consisting of gelatin and polyvinyl pyrrolidone described in Japanese Patent O.P.I. Publication No. 229556/1981.

Preferable amount of binder to be used is usually 0.05 g to 50 g, or more preferably, 0.1 g to 10 g per 1 $m^2$ of base material.

Binder should be preferably used 0.1 g to 10 g, or more preferably, 0.25 g to 4 g for 1 g of coloring matter donor.

The heat developable light-sensitive material of this invention can be obtained with forming a photograph component layer on the support, and support which can be used here include, for example, synthetic plastic film such as polyethylene film, cellulose acetate film and polyethylene and polyvinyl chloride, paper base material such as photographic base paper, printing paper, baryta paper and resin coated paper, and base material cured with electron radiation curing resin composition applied on it.

It is preferable to add some heat solvent to heat developable light-sensitive material of this invention, or if the light-sensitive material is transfer type using a image receiving member, to heat developable light-sensitive material and/or receiving member. Heat solvent is the compound to accelerate heat development and/or heat transfer. Such compounds include organic compound with polarity described in specifications of the U.S. Pat. No. 3,347,675, No. 3,667,959, RD (Research Disclosure) No. 17643 (XII), Japanese Patent O.P.I. Publication No. 229556/1984, No. 69730/1984, No. 84236/1984, No. 191251/1985, No. 232547/1985, No. 14241/1985, No. 52643/1980, No. 78553/1987, No. 42153/1967, No. 44737/1967, U.S. Pat. No. 3,438,776, No. 3,666,477, No. 3,667,959, Japanese Patent O.P.I. Publication No. 19525/1976, 24829/1978, 60223/1978, 118640/1978, and No. 198038/1978. Particularly useful compounds for embodying this invention include, for example, urea derivatives such as dimethylurea, diethylurea, phenylurea etc., amide derivatives such as acetamide, benzamide, p-toluamide, p-butoxybenzamide etc., sulfonamide derivatives such as benzene sulfonamide, alpha-toluen sulfonamide etc., polyvalent alchohols 1,5-pentanediol, 1,6-hexanediol, 1,2-cyclohexanediol, pentaerythritol, trimethylolethane etc. or polyethylene glycols.

More preferably, water-insoluble solid heat solvent is used as the heat solvent mentioned above. Here, water-insoluble solid heat solvent means the compound which is in solid state in ordinary temperature but becomes liquid state in high temperature (60° C. or more, preferably 100° C. or more, and particularly preferable temperature is 250° C. or more), and whose ratio of inorganicity/organicity (refer to "Yuuki gainenzu" (organicity conceptual diagram), by Yoshio Kohda, Sankyo Shuppan Co., Ltd., 1984) falls in the range from 0.5 to 3.0, or preferably 0.7 to 2.5, or far more preferably 1.0 to 2.0.

An example of above water-soluble heat solvents is described in Japanese O.P.I. Publication No. 136645/1987 and No. 139549/1987.

Heat solvent can be added to the light-sensitive silver halide emulsion layer, intermediate layer, protective layer, or image receiving layer of the receiving member, in order to obtain various effects corresponding to the layer.

Preferable addition amount of heat solvent is usually 10 to 500% by weight, or more preferably, 30 to 200% by weight of the binder amount.

Heat developable light-sensitive material of this invention may contain various additives other than the contents mentioned above, if required.

Substance known as a toning agent for heat developable light-sensitive materials may be added to heat developable light-sensitive material of this invention. Tone agents include, for example, compounds described in Japanese Patent O.P.I. Publication Nos. 4928/1971, 6077/1971, 5019/1974, 2524/1975, 67132/1975, 67641/1975, 114217/1975, 33722/1977, 99813/1977, 1020/1978, 55115/1978, 76020/1978, 125014/1978, 156523/1979, 1565324/1979, 156525/1979, 156526/1979, 4060/1980, 4061/1980 and 32015/1980, and specifications of West German patent No. 2,140,406, No. 2,141,063, No. 2,220,618, and U.S. Pat. No. 3,847,612, No. 3,782,941, No. 4,201,582, and Japanese Patent O.P.I. Publication Nos. 207244/1982, 207245/1982, 1896328/1983 and 193541/1983.

Another example of development accelerator is the compound described in Japanese Patent O.P.I. Publication Nos. 177550/1984, and 111636/1984. And the development accelerator releasing compound described in Japanese Patent O.P.I. Publication No. 159642/1984 can be also used.

Fog inhibiting agents include, for example, higher fatty acid described in U.S. Pat. No. 3,645,739, mercuric salt described in Japanese Patent Examined Publication No. 11113/1972, N-halogen compound described in Japanese Patent O.P.I. Publication No. 47419/1976 mercapto compound emission compound described in specification of U.S. Pat. No. 3,700,457 and in Japanese Patent O.P.I. publication No. 50725/1976, arylsulfonic acid described in Japanese patent No. 125016/1974, carboxylic acid lithium salt described in Japanese Patent O.P.I. Publication No. 47419/1976, oxidizing agent described in specification of Britsh patent No. 1,455,271 and Japanese Patent O.P.I. Publication No. 101,019/1975, sulfinic acids or thiouracyles described in Japanese Patent O.P.I. Publication No. 19825/1978 disulfide and polysulfide compounds described in Japanese Patent O.P.I. Publication No.81124/1976 and No. 93149/1980, rosins or diterpenes, polymeric acid with free carboxyl group or sulfone acid group described in Japanese Patent O.P.I. Publication No. 104338/1976, thiazolinethion described in specification of U.S. Pat.

No. 4,138,265, 1,2,4-triazole or 5-mercapto-1,2,4-triazole described in Japanese Patent O.P.I. Publication No. 51821/1979 and U.S. Pat. No. 4,137,079, 1, 2, 3-thiatriazoles described in Japanese Patent O.P.I. Publication No. 142331/1980, dihalogen compound or trihalogen compound described in Japanese patent Nos. 46641/1984, 57233/1984 and 57234/1984, thiol compound described in Japanese Patent O.P.I. Publication No. 111636/1984, hydroquinone derivatives described in Japanese Patent O.P.I. Publication No. 198540/1985, and combined use of hydroquinone derivative and benzotriazole derivative.

Other particularly preferable fog inhibiting agents include depressant with hydrophilic group described in Japanese Patent O.P.I. Publication No. 78554/1987, polymer depressant described in Japanese Patent O.P.I. Publication No. 121452/1987 and depressant compound with ballast radical described in Japanese Patent O.P.I. Publication No. 123456/1987.

Further, inorganic or organic base, or basic precursor can be added. Basic precursors include compounds which release basic substance by heat decarbonization, for example, quanidinium trichloroacetate, and compounds which release amines through decomposition caused by reactions such as intramolecular nucleophilic substituting reaction; more specifically, base releasing agents described in Japanese Patent O.P.I. Publication Nos. 130745/1981, and 132332/1981, Britsh patent No. 2,079,480, U.S. Pat. No. 4,060,420, Japanese Patent O.P.I. Publication Nos. 157637/1984, 166943/1984, 180537/1984, 174830/1984, and 195237/1984.

Other additives used for heat developable light-sensitive materials if required are, for example, anti-halation dye, fluorescent whitening agent hardener, antistatic agent, plasticizer, spreading agent, mating agent, surface active agent and fading prevention agnet. Specific descriptions of these agents are in the RD (Research Disclosure) No. 17029, June, 1978, Vol. 170 and Japanese Patent O.P.I. Publication No. 135825/1987.

The heat developable light-sensitive material of this invention contains (a) light-sensitive silver halide, (b) reducing agent, (c) binder, and (d) color providing material to obtain colored images. If required, containing of (e) organic silver is preferable. These substances may be basically contained in one heat developable light-sensitive layer, but they are not necessarily in a single photographic component layer. For example, heat developable lightsensitive layers can be divided into two groups of layers, one contains the materials (a), (b), (c) and (e), and the other layer group adjacent to it contains (d) color providing material. If the agents can be contained in two or more composing layers if they can react each other.

Further, heat developable light-sensitive layer can be divided into 2 or more layers, such as low sensitivity layer and high sensitivity layer, or high density layer and low density layer.

The heat developable light-sensitive material of this invention has one or more heat developable light-sensitive layer(s). Generally, for full color light-sensitive material, three heat developable photosensitive layers of different spectrial sensitivity are provided and each photosensitive layer forms or release dye with different hues when heat developed.

Usually, blue-sensitive layer is combined with yellow color providing material, green-sensitive layer with magenta color providing material, and red-sensitive layer with cyan color providing material, but other combinations are also acceptable. And a near infrared photosensitive layer may be included.

Composition of each layer is freely selected according to the purpose. For example, layer placement order of the support may be red-sensitive layer first, then greensensitive layer, and then blue-sensitive layer; or reversely, blue-sensitive layer first, then green-sensitive layer and then red-sentitive layer on the support; or green-sensitive layer first, then red-sensitive layer, and then blue-sensitive layer.

The heat developable light-sensitive material of this invention may be provided, other than the heat developable light-sensitive layer mentioned above, with non-lightsensitive layers such as substrate, intermediate layer, protective layer, filter layer, backing layer and peeling layer. To apply the above mentioned heat developable light-sensitive layer and these non-light-sensitive layers on the support, the same method as used in application and preparation of general silver halide light-sensitive material is adopted.

The heat developable light-sensitive material of this invention will be developed after exposure, usually in the temperature range of 80° C. to 200° C., or more preferably, 100° C. to 170° C., by heating for 1 to 180 seconds, or more preferably, 1.5 seconds to 120 seconds. Transfer of diffusible dyes to the image receiving layer may be conducted at the same time as the heat development by close contact of the receiving member to the light-sensitive surface of the light-sensitive material and the receiving layer, or may be conducted by close contact of the receiving layer to the receiving member after heat development, or by close contact and additional heating (if necessary) after the water supply. Pre-heating may be conducted before exposure in the temperature range from 70° C. to 180° C. Light-sensitive material and receiving member may be heated immediately before the heat development transcription in the temperature from 80° C. to 250° C. to improve mutual contact, as described in Japanese Patent O.P.I. Publication No. 143338/1985 and No. 162041/1986.

For the heat developable light-sensitive material of this invention, various heating means can be applied.

All the heating means applicable to usual heat developable light-sensitive materials can be utilized. For example, contact to heated block or plate, touch with heat roller or heat drum, passing through atmosphere of high temperature, high-frequency heating, or utilization of Joule heat produced by electricity in conductive layer containing conductive substance such as carbon black and being mounted on back side of the receiving member for heat transfer. Heating pattern is not limited, and either heating after pre-heating, or short-period heating with high temperature, or long-period heating with low temperature, or consecutive temperature rising or consecutive temperature lowering or repetition of both, or non-consecutive heating is applicable, but a simple pattern is preferred. Exposure and heating can be synchronously proceeded.

When the heat developable light-sensitive material of this invention is of transfer type, receiving member will be provided as described above. Receiving layer of the receiving member to be effectively used only needs to have a function to accept dye in the heat developable lightsensitive layer released or formed by heat development. For example, a polymer containing tertiary amine or quaternary ammonium salt described in U.S. Pat. No. 3,709,690 is preferably used. Typical receiving layer for diffusion transfer can be obtained by application of polymer containing ammonium salt or tertiary amine mixed with gelatin or polyvinyl alcohol on the support. Another useful coloring matter receptor is the one formed from heat-resistant organic high-molecular substance with glass transition temperature in the range from 40° C. to 250° C., described in Japanese Patent O.P.I. Publication No. 297250/1982.

These polymers may be provided on the base substrate as a image receiving layer, or may be used as the base material itself.

Examples of such heat-resistant high-molecular substance are polyacetals including polystyrene, polystyrene derivative having substituent group with four or less carbon atoms, polyvinlyl cyclohexane, polydivinyle benzene, polyvinyl pyrrolidone, polyvinyl carbazole, polyallyl benzene, polyvinlyl alcohol, polivinyl formal and polyvinyl butyral; polyesters including polyvinyl chloride, chlorinated polyethylene, poly ethylene fluorotrichloride, polyacrylonitrile, poly-N, N-demethylallylamido, polyacrylate with p-cyanophenyl group, pentachlorophenyl group and 2, 4-dichlorophenyl group, polyacryl chloroacrylate, polymethyl methacrylate, polyethyl methacrylate, polypropyl methacrylate, polyisopropyl methacrylate, polypropyl methacrylate, polyisopropyl methacrylate, polyisobutyl methacrylate, poly-tert-butyl methacrylate, polycyclohexyl methacrylate, polyethylene glycol dimethacrylate, poly-2-cyano-ethyl methacrylate, polyethylene terephthalate; polycarbonates such as polysulfone and bispheno-A polycarbonate; polyanhydrides, polyamides and cellulose acetates. Further, synthetic polymers with glass transition temperature of 540° C. described in "Polymer Handbook, 2nd ed." (J. Brandrup, E.H. Immergut), published by John Wiley & Sons are also useful. In general, useful molecular weight of the high-molecular substance described above is 2,000 to 200,000. Either single type of high-molecular substance or blend of two or more types of high molecular substance may be used, or two or more high-molecular substance may be combined for use as copolymer.

Particularly preferable receiving layers include the layer consisting of polyvinyl chroride described in Japanese Patent O.P.I. Publication No. 223425/1984 and the layer consiting of polycarbonate and plasticizer described in Japanese Patent O.P.I. Publication No.19138/1985.

These polymers may be used as base material and receiving layer (receiving member) at the same time, and in such case, the base material may be formed of either a single layer or plurality of layers.

The support of receiving member may be transparent support, opaque support or anything, and the usable materials include, for example, films of polyethylene tephtalate, polycarbonate, polystyrene, polyvinylchloride, polyethylene, and polypropylene, and supports prepared by adding pigments such as titanium oxide, barium sulfate and calcium carbonate to the support above, baryta paper, RC paper with pigment containing thermoplastics laminated on it, cloths, glasses, metals such as aluminum, and support with electron radiation curing resin component containing pigments applied and hardened, and support with pigment containing coating layer on the above support. Cast-coated paper described in Japanese Patent O.P.I. Publication No.283333/1987 is also useful as the support.

Support prepared by coating and hardening of electron radiation curing resin component containing pigments on paper, or support having pigment coating layer on which electron radiation curing resing component is coated and hardened can be used as receiving member, because the resing layer can be utilized as receiving layer itself.

Heat developable light-sensitive material of this invention can be mono-sheet type heat developalbe light-sensitive material provided with photosensitive layer and image receiving layer on the same support, as described in RD (Research Disclosure) No. 15108, as well as Japanese Patent O.P.I. Publication No. 198458/1982, 207250/1982, and 80148/1986.

It is preferable to provide a protective layer for the heat developable light-sensitive material of this invention.

Various additives used in the field of photographic material can be used in protective layer. Such additives include mat agent, colloidal silica, lubricant, organic fluoride, especially, fluorine group surface active agent, antistatic agent, ultraviolet light absorber, high boiling solvent, antioxidant, hydroquinone derivative, polymer latex, surface active agent including high-molecular surface active agent, hardener (including high-molecular hardener), organic silver salt particles and non-light-sensitive silver halide particles.

These additives are described in RD (Research Disclusure) No. 17029, June, 1978, Vol. 170, and Japanese Patent O.P.I. Publication No. 135825/1987.

[EXAMPLES]

Examples embodying the invention are hereinafter described. As a matter of course, however, the scope of the examples of the invention is not limited only to the examples described below.

EXAMPLE-1

In this example, core/shell type silver iodidobromide emulsion, organic silver salt dispersion, color providing dispersion and reducing agent dispersion were prepared as described below, and using these emulsion and dispersions, heat developable light-sensitive material samples No. 1 to No. 10 were made. Receiving member preparation is also described below, for the present invention was applied to the transcription type heat developable light-sensitive material in this example.

[1]Preparation of core/shell type silver iodobromide emulsion:

Following method was used to prepare core/shell type emulsion Em-1 with silver iodobromide content of 1 mol%, and with average particle size of 0.3 μm.

Using the mixing stirrer described in specifications of Japanese Patent O.P.I. Publication Nos. 92523/1982 and 92524/1982 and in the temperature of 40° C., aqueous solution B-1 containing 0.04 mol/l of potassium iodide and 1.94 mol/l of potassium bromide, and 500 ml of solution C, equeous solution containing 1 mol of silver nitrate and 2 mol of ammonia were added to 1000 ml of aqueous solution A containing 20 g of oceine gelatin, 0.2 mol of ammonia and 0.0385 mol of silver iodobromide seed emulsion, average particle size is 0.1 μm, content of silver iodide is 2 mol % at the same time, keeping the same pAg and at the maximum speed allowed to avoid small particles generation to prepare a core. In this step, the emulsion was checked that silver halide grains of the emulsion were monodispersive. After the addition of B-1 solution, B-2 solution contaning 0.98 mol/l of potassium bromide was added together with the solution C to form a sell. During addition, pH was kept at 9.0, and pAg at 9.8. pH and pAg were controlled with 50% acetic acid aqueous solution and 25% potassium bromide aqueous solution respectively. Thus prepared was the core/shell type silver halide emulsion Em-1 having regular octahedron particles with average particle size of 0.3 μm and particle size distribution of 13%, and containing 2 mol % of silver iodide in core and 0 mol% in shell, and mol % in average for the entire emulsion, and having the shell thickness of 0.03 μm.

This emulsion Em-1 was washed with water and desalted, and oceine gelatin aqueous solution containing 30 g of gelatin was added to the emulsion, and after dispersion, distilled water was added to make the emulsion 800 ml.

[2]Preparation of organic silver salt dispersion-1:

28.8 g of 5-methylbenzotriazole silver salt obtained by reaction of 5-methylbenzotriazole and silver nitrate in water-alcohol mixed solvent, 16.0 g of poly (N-vinyl pyrrolidone) and 1.33 g or 4-sulfobenzotriazole sodium salt were dispersed with alumina ball mill. This solution was arranged to have pH of 5.5 and quantity of 200 ml.

[3]Preparation of light-sensitive silver halide dispersion:

Silver halide emulsion Em-1 prepared in the step above was subjected to chemical sensitization and spectral sensitization with sensitizers given below to prepare red-sensitive, green-sensitive and blue-sensitive silver halide emulsion.

| (a) Preparation of red-sensitive silver iodidobromide emulsion | |
|---|---|
| Silver halide emulsion Em-1 | 200 ml |
| Sodium thiosulfate | 3.0 mg |
| Chloroauric acid | 0.4 mg |
| Ammonium thiocyanate | 10 mg |
| 1% methanol solution of sensitizing dye (a) | 12 ml |

Sensitizing dye (a)

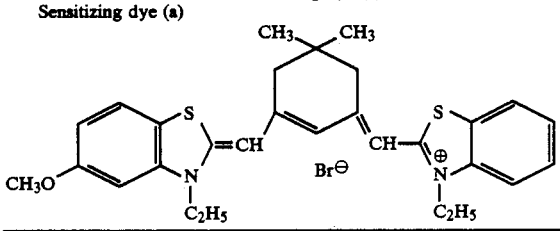

| (b) Preparation of green-sensitive silver iodidobromide emulsion | |
|---|---|
| Silver halide emulsion Em-1 | 200 ml |
| Sodium thiosulfate | 4.0 mg |
| Gold chloride acid | 0.4 mg |
| Ammonium thiocyanate | 10 mg |
| 1% methanol solution of sensitizing dye (b) | 12 ml |

Sensitizing dye (b)

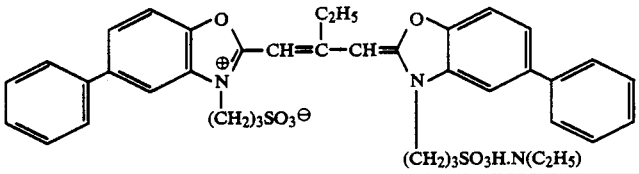

| (c) Preparation of blue-sensitive silver iodebromide emulsion | |
|---|---|
| Silver halide emulsion Em-1 | 200 ml |
| Sodium thiosulfate | 3.0 mg |
| Gold chloride acid | 0.4 mg |
| Ammonium thiocyanate | 10 mg |

-continued

| (c) Preparation of blue-sensitive silver iodebromide emulsion | |
|---|---|
| 1% methanol solution of sensitizing dye (c) shown below | 12 ml |

Sensitizing dye (c)

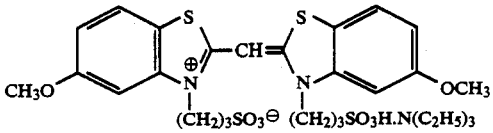

[4]-1 Preparation of color provding material dispersion-1

83 g of color providing material shown below (1), 5.0 g of hydroquinone compound below and anti-fogging agent below were dissolved in 200 ml of ethyl acetate. This solution was mixed with 720 ml of aqueous gelatin solution containing 124 ml of 5% by weight aqueous alkanol XC (manufactured by Dupont) solution and 30.5 g of phenyl carbamoylized gelatin (type 17819, Ruslo company), and dispersed with supersonic homogenizer. After distilling out ethyl acetate content, pH of this solution was arranged to be 5.5 and the quantity was made to 795 ml.

Color providing material (1)
(Yellow color providing material)

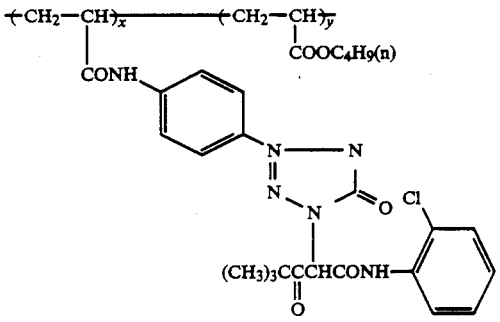

x = 70% by weight
y = 30% by weight

Hydroquinone compound

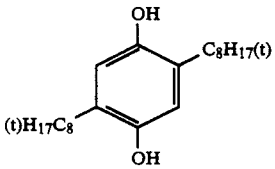

-continued

Anti-fogging agent

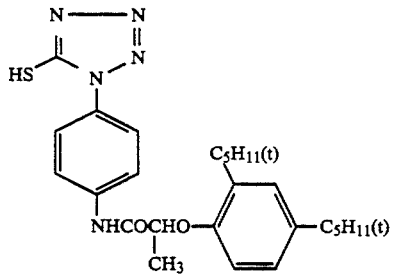

[4]-2 Color providing material dispersion -2

This dispersion was prepared in the same way as the color provided material dispersion-1 except that the color providing material was changed to the color providing material (3) shown below (adding amount: 90 g).

Color providing material (3)
(Cyan color providing material)

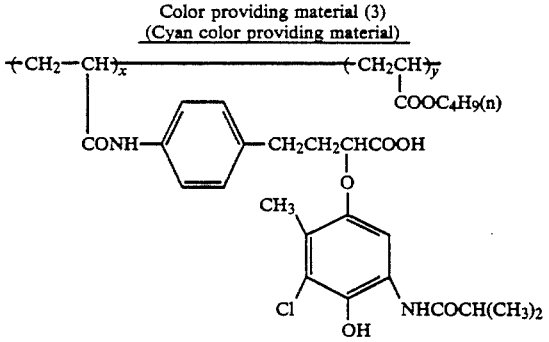

x = 60% by weight
y = 40% by weight

[4]-3 Color providing material dispersion-3

This dispersion was prepared in the same way as the color providing dispersion-1 except that the color providing material (2) shown below (35.5 g) was used.

Color providing material (2)
(Magenta color providing material)

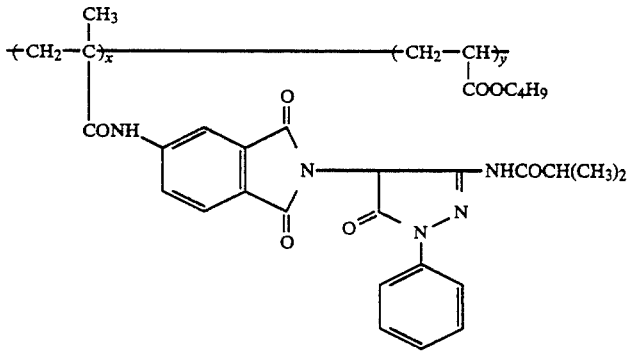

x = 40% by weight
y = 60% by weight

[5]Preparation of reducing agent dispersion-1

23.3 g of reducing agent below, 1.10 g of development accelerator below, 14.6 g of poly (N-vinyl pyrrolidone) and 0.50 g of fluorine containing surface active agent below were dissolved in water. This solution was arranged to have pH at 5.5 and the solution quantity was made to be 250 ml.

Reducing agent

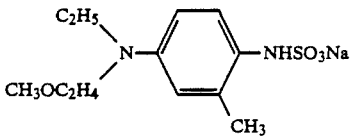

Development accelerator

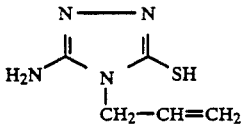

Surface active agent

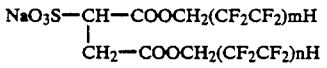

(m, n = 2 or 3)

[6]Preparation of heat developable material-1

12.5 ml of organic silver salt dispersion-1 prepared in the above step, 10 ml of above described green-sensitive silver halide emulsion, 2.0 g of gelatin, 39.8 ml of color providing material dispersion-3 and 12.5 ml of reducing agent dispersion-1 were mixed. 2.50 ml of hardener, solution [tetra (vinylsulfonylmethyl) methane was reacted with taurine with the weight ratio 1:1 and dissolved to 1% aquious solution of phenyl carbamoyl gelatin to make the tetra (vinylsulfonylmethy) methane content 3% by weight.]and 3.80 g of polyethylene glycol 300 (Kanto chemical Co., Ltd.) as heat solvent were added and prepared to obtain application solution. THis solution was coated on the subbed photographic polyethylene terephthalate film of 180 μm thick so as to make the silver amount 1.2 g/m$^2$, in order to make the first light-sensitive layer.

On the first light-sensitive layer, the following composition was coated to make the first intermediate layer.

| | |
|---|---|
| Gelatin | 0.6 g/m$^2$ |
| Polyvinyl pyrrolidone | 0.3 g/m$^2$ |
| Following compounds | 0.25 g/m$^2$ |

-continued

| | |
|---|---|
| Methylbenztriazole silvers | 0.6 g/m$^2$ |
| p-buoxybenzamide | 1.0 g/m$^2$ |
| 2,4-dichloro-6-hydroxy-S-sodium triazine | 20 mg/m$^2$ |

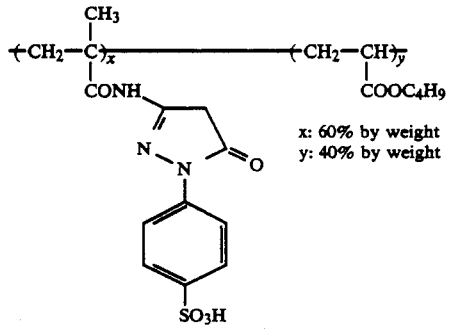

Coating solution prepared in the same way as that for the first light-sensitive layer except that red-sensitive silver halide emulsion was used for silver halide and color providing material dispersion was changed to color providing material dispersion-2 was coated to make silver amount 1.1 g/cm$^2$ for second light-sensitive layer application.

Coating solution prepared by adding yellow filter color (0.2 g/m$^2$) below to the components of the primary intermediate layer was applied on the secondary photosensitive layer to form second intermediate layer.

Yellow filter dye

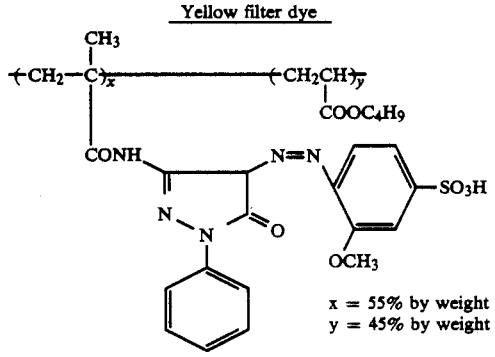

On the second intermediate layer, a coating solution prepared in the same manner as in the solution for the first light-sensitive layer except that the blue-sensitive silver halide emulsion and color providing material dispersion-1 were used in stead of the green-sensitive emulsion and color providing material dispersion-3, respectively, to form third light-sensitive layer.

Further, protective layer consisting of the contents below was made on the third sensitive layer to obtain a multi-layer light-sensitive material (Sample No. 1).

| | |
|---|---|
| Gelatin | 0.28 g/m$^2$ |
| Polyvinylpyrrolidone | 0.14 g/m$^2$ |
| $SiO_2$ | 0.36 g/m$^2$ |
| Safron | 1.0 g/m$^2$ |
| p-butoxybenzamide | 0.42 g/m$^2$ |

Samples were prepared in the same way as the sample No. 1 except that the compound of the present invention and the reference compound (A) (compound types and amount are given in Table 1) were added to the blue-sensitive silver halide emulsion.

Reference compound (A)

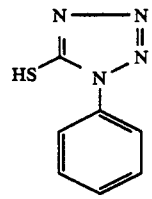

[7]Preparation of receiving member-1

Photographic baryta paper was coated with a tetrahydrofuran solution of polyvinyl chloride, n =1,100 (manufactured by Wako Jun-yaku Co.) to prepare the receiving member-1. Coating weight of polyvinyl chloride was 12 g/m$^2$.

Obtained light-sensitive material samples from No. 1 to No. 10 were separately exposed to red-light, green-light and blue-light of 800 CMS, joined with image receiving sheet below, and heat developed for 1 minute and 20 seconds at the temperature of 150° C. with heat developing machine (developer module 272, 3M Co., Ltd.). Immediately after development, light-sensitive material and image receiving member were separated to obtain transcribed image on the receiving member. Transfered densities, Dmax represents the maximum density, and $D_{min}$ represents fogging occurrence of obtained cyan, magenta and yellow colors were measured. Measurement result is shown in Table 1.

TABLE 1

| Sample No. | Compound added to blue photosensitive layer: Type | Amount [adding amount in mol per 1 mol of silver halide] | Yellow image $D_{max}$ | Yellow image $D_{min}$ | Sensitivity to blue-light exposure*(1) | Magenta image $D_{max}$ | Magenta image $D_{min}$ | Cyan image $D_{max}$ | Cyan image $D_{min}$ |
|---|---|---|---|---|---|---|---|---|---|
| 1 (Comparative) | — | — | 1.71 | 0.14 | 100 | 2.01 | 0.21 | 1.93 | 0.06 |
| 2 (Inventive) | (1) | $5.0 \times 10^{-3}$ mol | 1.91 | 0.16 | 165 | 2.02 | 0.22 | 1.95 | 0.06 |
| 3 (Inventive) | (1) | $1.5 \times 10^{-2}$ mol | 1.94 | 0.17 | 180 | 2.04 | 0.23 | 1.96 | 0.06 |
| 4 (Inventive) | (1) | $5.0 \times 10^{-2}$ mol | 1.94 | 0.24 | 180 | 1.98 | 0.22 | 1.94 | 0.06 |
| 5 (Inventive) | (4) | $5.0 \times 10^{-3}$ mol | 1.90 | 0.16 | 165 | 2.02 | 0.23 | 1.96 | 0.07 |
| 6 (Inventive) | (4) | $1.5 \times 10^{-2}$ mol | 1.94 | 0.17 | 180 | 2.04 | 0.21 | 1.92 | 0.07 |
| 7 (Inventive) | (8) | $5.0 \times 10^{-3}$ mol | 1.88 | 0.16 | 150 | 2.02 | 0.22 | 1.94 | 0.07 |
| 8 (Inventive) | (8) | $1.5 \times 10^{-2}$ mol | 1.90 | 0.17 | 160 | 2.04 | 0.22 | 1.94 | 0.07 |
| 9 (Comparative) | (A) | $5.0 \times 10^{-2}$ mol | 2.04 | 1.01 | 80 | 2.15 | 0.77 | 1.95 | 0.22 |
| 10 (Comparative) | (A) | $5.0 \times 10^{-2}$ mol | 2.14 | 1.30 | 60 | 2.21 | 0.80 | 1.98 | 0.23 |

*(1)Relative sensitivity compared to saimple No. 1. The sensitivity of the sample No. 1 is represented as 100.

As understood from Table 1, samples from No. 2 to No. 8 relating to this invention have high maximum density particularly for yellow image and high developability, and lowered particularly for yellow image, and have high sensitivity for blue-light exposure.

What is claimed is:

1. A heat developable color photographic material comprising a support having thereon photographic component layers containing at least a blue-sensitive silver halide, a reducing agent, an organic silver salt, and a binder wherein, a layer of said photographic component layers containing said blue-sensitive silver halide, contains a compound represented by the following formula I:

Formula I

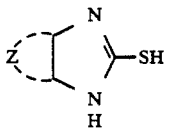

wherein Z' represents a group of atoms necessary for completing an aromatic ring or a heterocyclic ring, said aromatic ring or heterocyclic ring may have a substituent and may have a ring condensed therewith.

2. The material of claim 1, wherein said compound is represented by the following formula II:

Formula II

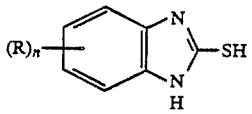

wherein R represents a hydrogen atom, an alkyl group, an aryl group, a substituted aryl group, an alkoxy group, or an aryloxy group; n represents an integer of 0, 1 or 2, and R may form a ring condensed with the benzene ring of formula II.

3. The material of claim 1, wherein said layer contains said compound represented by the formula I in an amount of from $3.0\times10^{-3}$ mol to $2.0\times10^{-1}$ mol per mol of silver halide contained in said layer.

4. The material of claim 3, wherein said layer contains said compound represented by the formula I in an amount of from $5.0\times10^{-3}$ mol to $1.0\times10^{-1}$ mol per mol of silver halide contained in said layer.

5. The material of claim 1, wherein said material contains a color providing material capable of forming or releasing a diffusible dye.

6. The material of claim 5, wherein said color providing material is a compound capable of forming or releasing a diffusible dye upon reaction with an oxidized product of said reducing agent.

7. The material of claim 5, wherein said color providing material is a compound represented by the following formula 1 or 2:

Formula 1

Cp—(J)—(B)

Formula 2

CP—(J)—(Y)$_l$—(Z')—(L)

wherein Cp represents a group capable of forming a diffusible dye upon reaction with an oxidized product of said reducing agent, J is a divalent combinating group capable fo being cleaved upon reaction with an oxidized product of said reducing agent, B represents a ballast group, Y represents an alkylene group, an arylene group or an alalkylene group, $l$ represents an integer of 0 or 1, Z' represents a divalent organic group and L represents an ethylenic unsaturated group or a group having an ethylenic unsaturated group.

8. The material of claim 1, wherein said reducing agent is an N-(p-N,N-dialkyl)phenylsulfaminic acid salt.

* * * * *